US005261542A

United States Patent [19]

Robbie

[11] Patent Number: 5,261,542

[45] Date of Patent: Nov. 16, 1993

[54] ROTATING BOOM

[75] Inventor: Malcolm G. Robbie, Stow, Ohio

[73] Assignee: Allied Steel & Tractor Products, Inc., Solon, Ohio

[21] Appl. No.: 933,378

[22] Filed: Aug. 20, 1992

Related U.S. Application Data

[63] Continuation-in-part of Ser. No. 738,313, Jul. 30, 1991, abandoned.

[51] Int. Cl.[5] ..... B66C 23/00

[52] U.S. Cl. ..... 212/271

[58] Field of Search ..... 212/271, 223, 227-230, 212/232, 235, 238, 253, 255, 259; 175/122, 135, 162, 189, 203

[56] References Cited

U.S. PATENT DOCUMENTS

| | | | |
|---|---|---|---|
| 3,224,292 | 4/1966 | Elliott | 212/238 |
| 3,601,169 | 8/1971 | Hamilton et al. | 212/238 |
| 3,775,798 | 12/1973 | Thornton-Trump | 212/238 |
| 4,342,257 | 8/1982 | Weyer | 92/31 |
| 4,969,789 | 11/1990 | Searle | 212/238 |
| 5,033,554 | 7/1991 | Younes | 175/203 |

FOREIGN PATENT DOCUMENTS

| | | | |
|---|---|---|---|
| 43466 | 6/1969 | Finland | 212/238 |

OTHER PUBLICATIONS

"Hy-Ram ®—Allied's Boom Mounted Hydraulic Impact Hammer," Allied steel & tractor Co., 1987.

*Primary Examiner*—Sherman Basinger

*Attorney, Agent, or Firm*—Watts, Hoffmann, Fisher & Heinke

[57] ABSTRACT

A rotating stick comprises a shaft, a prime mover, an outer casing and first and second bearings. The prime mover is aligned with the central axis of the shaft. The outer casing encloses the prime mover and at least partially encloses the shaft. The first and second bearings include first and second annular bodies mounted inside the outer casing. These two bodies cooperate to support the shaft in the outer casing for relative rotation. The second bearing includes a transverse surface which transfers a portion of the periodic forces propagating along the shaft to the outer casing. These forces are dissipated by the outer casing so that the energy propagated to the prime mover is minimized.

5 Claims, 4 Drawing Sheets

ROTATING BOOM

RELATED APPLICATIONS

This is a continuation-in-part of U.S. patent application Ser. No. 07/738,313, filed Jul. 30, 1991 and now abandoned.

FIELD OF THE INVENTION

The present invention relates to power-driven booms, and more particularly to a boom including a rotating stick capable of pointing a working member such as a hydraulic hammer pivotally supported at the end of the boom in substantially any direction forward of a plane intersecting the end of the rotating stick and orthogonal to a central axis of the rotating stick.

BACKGROUND OF THE INVENTION

One application for power-driven booms is in the repair of large smelting drums in converters for smelting metal ore. Drums of this type consist of cylindrical chambers having horizontal longitudinal axes and openings in their annular walls for access to the chambers. During the smelting process, deposits of hardened material build up near the openings to the drums as well as on various inner surfaces within the drums. These deposits are removed by hydraulic reciprocating hammers which chisel the deposits away from the inner walls of the drums.

A hammer of this type is supported at the distal end of a jointed boom which is inserted into the drum through the opening. In a preferred construction, the jointed boom consists of an elongated boom member hinged at a proximal end to a base and a stick member hinged near its proximal end to a distal end of the boom member. The boom member, stick member and hammer are each coupled near their proximal ends to hydraulic cylinders which cooperate to position the hydraulic hammer near the deposits in the drum.

It is desirable that the stick member be made as light as possible to minimize the power required to position the hammer. At the same time, it is desirable that the stick be made as rugged as possible to withstand the periodic forces generated as the hammer strikes a surface to be cleaned. These reaction forces propagate through the rotating stick in the form of elastic waves. For example, the magnitude of these reaction forces may be as high as 10,000 foot-pounds.

DISCLOSURE OF THE INVENTION

A preferred rotating stick comprises a shaft, a prime mover and an outer casing in which the shaft is supported for relative rotation by first and second bearings and in which the prime mover is aligned with the central axis of the shaft. The outer casing encloses the prime mover and at least partially encloses the shaft.

Aligning the prime mover with the shaft simplifies the coupling of the prime mover to the shaft and leads to a structure which is compact and balanced. An alternative structure would be to position the prime mover to the side of the central axis of the shaft, such as on a flange external to the outer casing of the stick. The alternative structure would necessary be less compact in order to accommodate the eccentric mounting of the prime mover. Furthermore, it would be necessary to couple the prime mover to the shaft by means of gears or some other drive which would transmit power from the prime mover. The addition of parts to provide a coupling between the prime mover and shaft increases the likelihood of failure. Consequently, the alignment of the prime mover and shaft improve the appearance and performance of the rotating stick.

One drawback to aligning the prime mover directly with the shaft is that the periodic forces generated by the action of the hammer propagate through the shaft directly to the prime mover. These forces lead to cycling of the drive shaft with respect to other parts of the prime mover mounted inside the housing and to possible failure of the prime mover.

In the preferred embodiment of the present invention, the second bearing includes a radial thrust surface which transfers radial thrust forces generated by a working member such as a hammer from the shaft to the outer casing. Without this thrust surface, all of the forces generated by the hammer would propagate along the rotating stick in the form of elastic waves to the prime mover. The thrust surface transfers a portion of the elastic waves to the outer casing, where the energy of that portion is dissipated. The dissipation of the portion of the elastic waves reduces the periodic forces acting on the prime mover, which tends to increase the life of the prime mover.

According to one embodiment, the prime mover is a rotary hydraulic actuator. Suitable hydraulic actuators, commercially available and familiar to those skilled in the art, use fluid pressure for turning a drive shaft to provide a motive power output. Other types of devices may be used as long as they provide sufficient power and control to accurately position the working member without adding excessive bulk to the stick member.

The hydraulic actuator includes a rotatable spline fixed to the drive shaft of the prime mover. Advantageously, the shaft of the rotatable stick comprises a hollow tube having an end plate including an aperture constructed to mate with the rotatable spline for coupling the shaft to the actuator. Splining the drive shaft of the actuator to the shaft of the rotating stick helps to isolate the drive shaft from elastic waves propagated down the shaft. As a result, the axial forces acting on the drive shaft are reduced, thereby tending to increase the life of the actuator.

The rotating stick finds use as part of a jointed boom comprising a rotating stick member, a boom member defining a boom axis and pivotally supporting the outer casing of the rotating stick member for pivotal movement in an imaginary plane containing the boom axis and the shaft axis, and a linear actuator pivotally coupled near a proximal end to the boom member and near a distal end to the rotating stick member for pivoting the rotating stick member with respect to the boom member. The rotating stick member has a shaft, a prime mover coupled to the shaft in alignment with the shaft axis, an outer casing enclosing the prime mover and at least partially enclosing the shaft, a first bearing and a second bearing. The second bearing includes a thrust surface for receiving and transferring axial thrust forces from the shaft to the outer casing. These elements cooperate to reduce the amount of shock which is transmitted from a working member at the distal end of the stick member to the prime mover.

According to the embodiment, the outer casing includes a clevis having a pivot axis for pivotal coupling to the linear actuator and a boom member pivot axis for pivotal coupling to the boom member, the pivot axis of the linear actuator lying proximally of the boom member pivot axis.

The invention is especially useful when embodied as an apparatus for loosening deposits on an interior lining of smelting drums. The apparatus comprises a hydraulic reciprocating hammer, a rotating stick member, a boom member and a base. A first linear actuator is pivotally coupled between the shaft and the hydraulic hammer for pivoting the hammer with respect to the shaft. Likewise, a second linear actuator is pivotally coupled between the boom member and the rotating stick member for pivoting the rotating stick member with respect to the boom member. A third linear actuator is pivotally coupled at a proximal end to the base and at a midsection of the boom member for pivoting the boom member with respect to the base. The structure of the rotating stick member is that of the preferred rotating stick described above.

While a preferred application of the jointed boom disclosed in this application is as a support for a hammer for cleaning smelting drums, the jointed boom may also be used in other applications. For example, the rotating stick member may support a shovel or scoop which is positioned and manipulated by means of the linear actuator and the prime mover.

From the foregoing, it will be apparent that one object of the present invention is to provide a boom having a rotating stick which reduces the intensity of elastic waves propagated back from a working member pivotally coupled to the distal end of the rotating stick and which tends to isolate an actuator that rotates the stick from damage due to these elastic waves. This and other objects and the advantages of the invention will become clearer from the following description of the preferred embodiment read in connection with the accompanying drawing.

DETAILED DESCRIPTION OF THE PREFERRED EMBODIMENT

Figure 1:
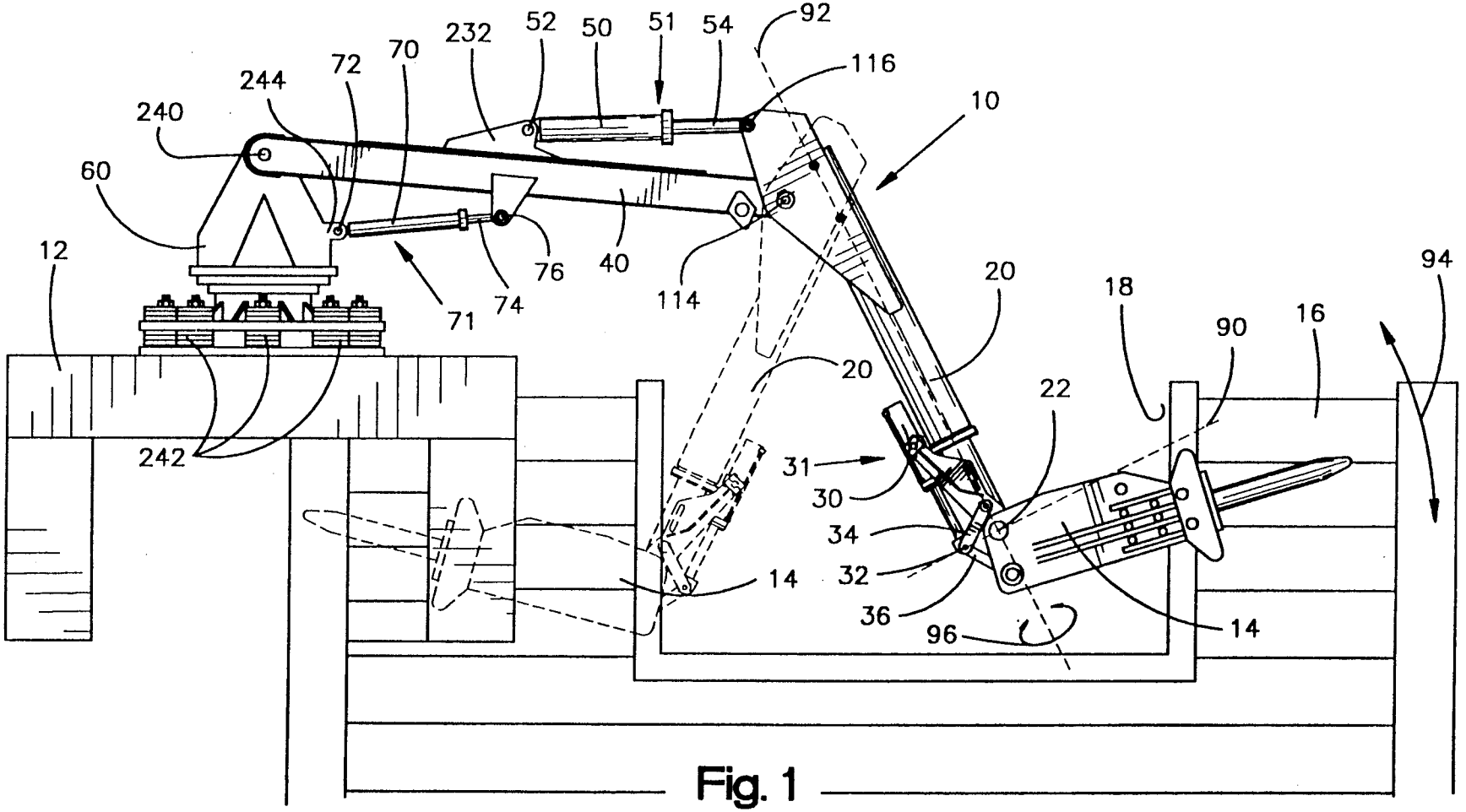
FIG. 1 is an elevational view of a pedestal boom system including a jointed boom supporting a hydraulic hammer for use in removing deposits from the interior walls of smelting drums.

A rotating stick member 20 embodying the present invention is shown in FIG. 1 as the last or distal section of a jointed boom 10 supported by a platform 12. The jointed boom 10 pivotably supports a hydraulic reciprocating hammer 14 along a pivot axis 22 for use in removing deposits from the interior wall of a smelting drum 16 having an opening 18 in its side wall.

Beside the rotating stick member 20, the jointed boom 10 includes a first hydraulic linear actuator 31 having a cylinder 30 trunnion coupled to the rotating stick member 20 and a piston rod 32 coupled to the hydraulic hammer 14 via linkages 34, 36. The jointed boom 10 also includes a boom member 40 pivotally supporting the rotating stick member 20. The boom member 40 is pivotally coupled to a cylinder 50 of a second hydraulic linear actuator 51 along a pivot axis 52, while a piston rod 54 of the second linear actuator 51 is pivotally coupled to the rotating stick member 20. A base 60 resting on the platform 12 pivotally supports the boom member 40 of the jointed boom 10. Finally, a cylinder 70 of a third hydraulic actuator 71 is pivotally coupled to the base 60 along a pivot axis 72, while a piston rod 74 of the third linear actuator 71 is coupled to the boom member 40 along a pivot axis 76.

The platform 12 on which the base 60 rests (shown schematically in relation to the smelting drum 16 in FIG. 1) rises slightly above the opening 18 in the side wall of the smelting drum 16 so that the rotating stick member 20 may be inserted through the opening 18 into the smelting drum 16.

Hardened material may be deposited on any inner surface of the smelting drum 16. As indicated by a comparison of the solid line and phantom line positions of the hammer 14 in FIG. 1, it is desirable that the rotating stick member 20 permit the hammer 14 to be pointed in any direction forward of a plane 90 passing through the pivot axis 22 and orthogonal to a central axis 92 of the rotating stick member 20. This is accomplished by permitting the hammer 14 to move through 180° of altitude (shown schematically by arrows 94) and 180° of azimuth (shown schematically by arrows 96).

A rotating stick member 20 capable of permitting this degree of rotation is shown in FIGS. 2–7. The rotating stick member 20 comprises an outer casing 100, a shaft 102 and a hydraulic rotary actuator 104. The shaft 102 is partially enclosed by the outer casing 100 and supported inside the outer casing 100 by a first bearing 106 adjacent a proximal end of the stick 20 and a second bearing 108 positioned adjacent a distal end of the stick 20.

Figure 2:
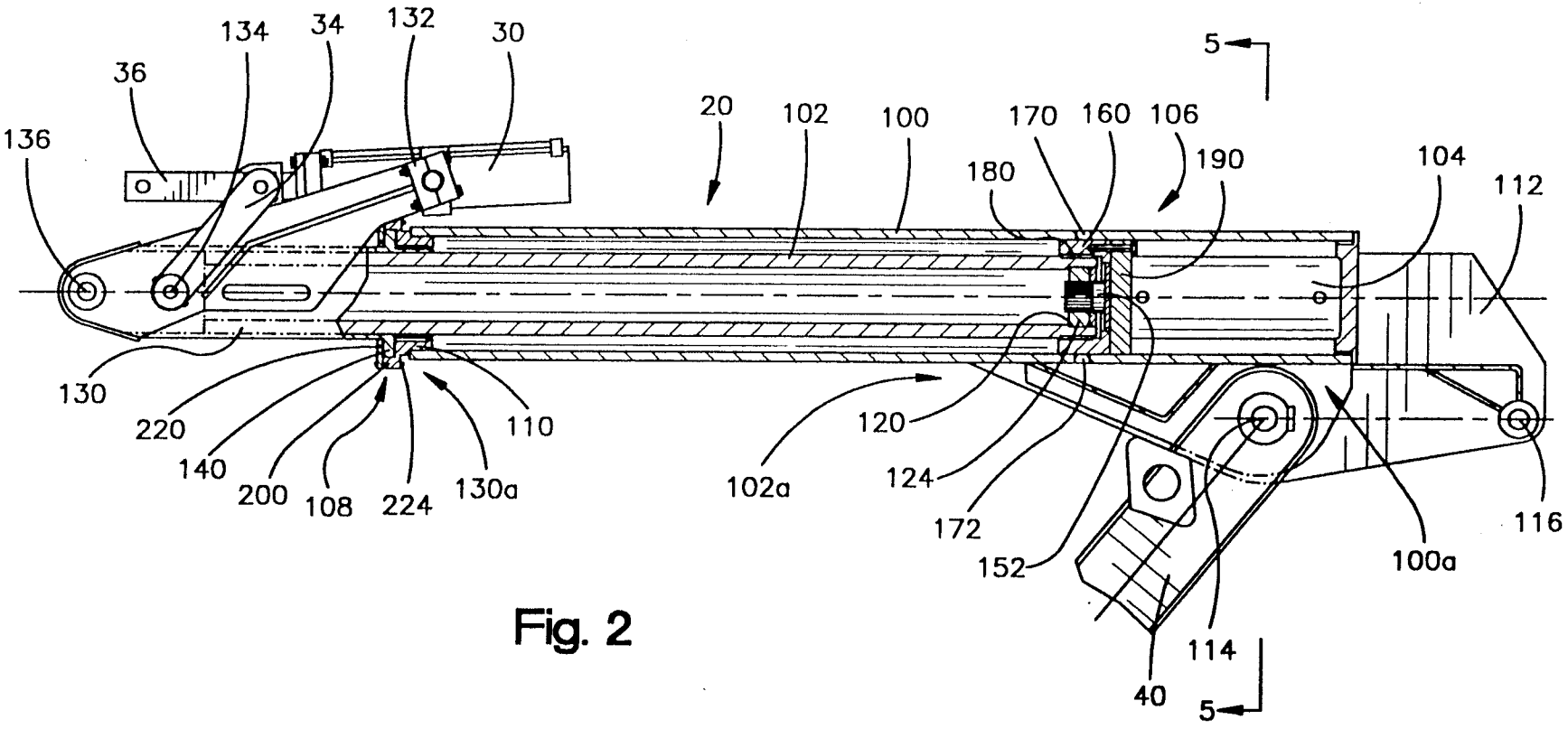
FIG. 2 is a side elevational view of a rotating stick with the side wall of the outer casing broken away to show the hydraulic actuator, shaft and bearings.
Figure 3:
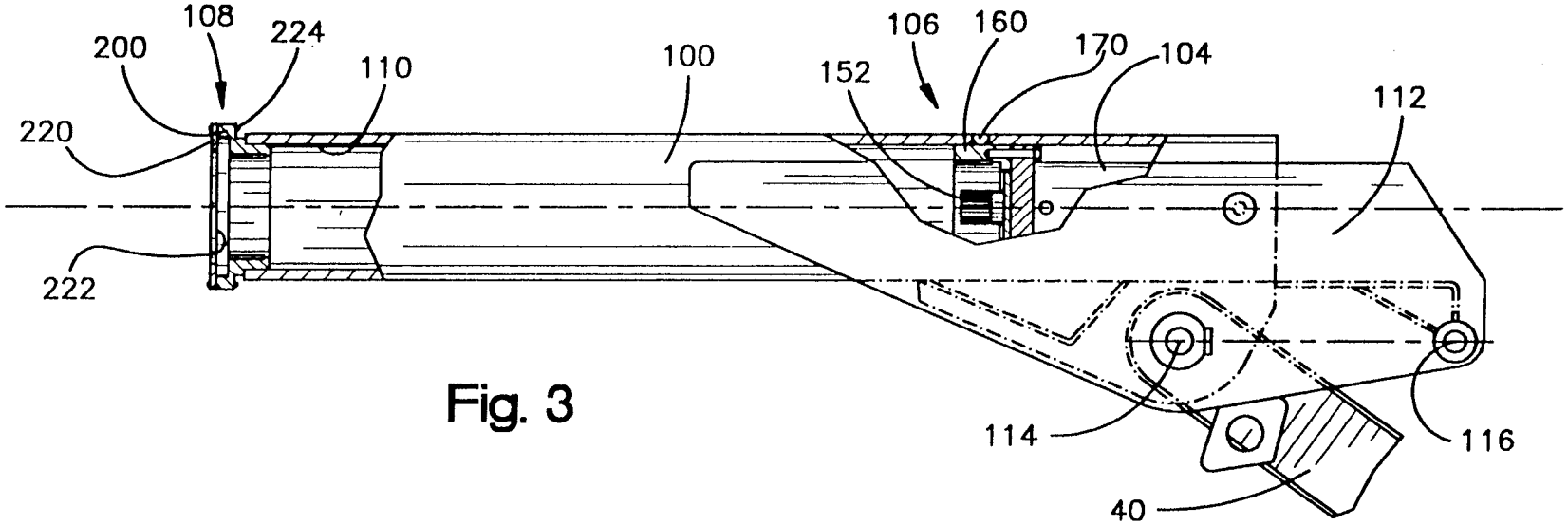
FIG. 3 is a side elevational view of the outer casing of the rotating stick with the outer casing broken away to show the bearings for supporting the shaft.
Figure 4:
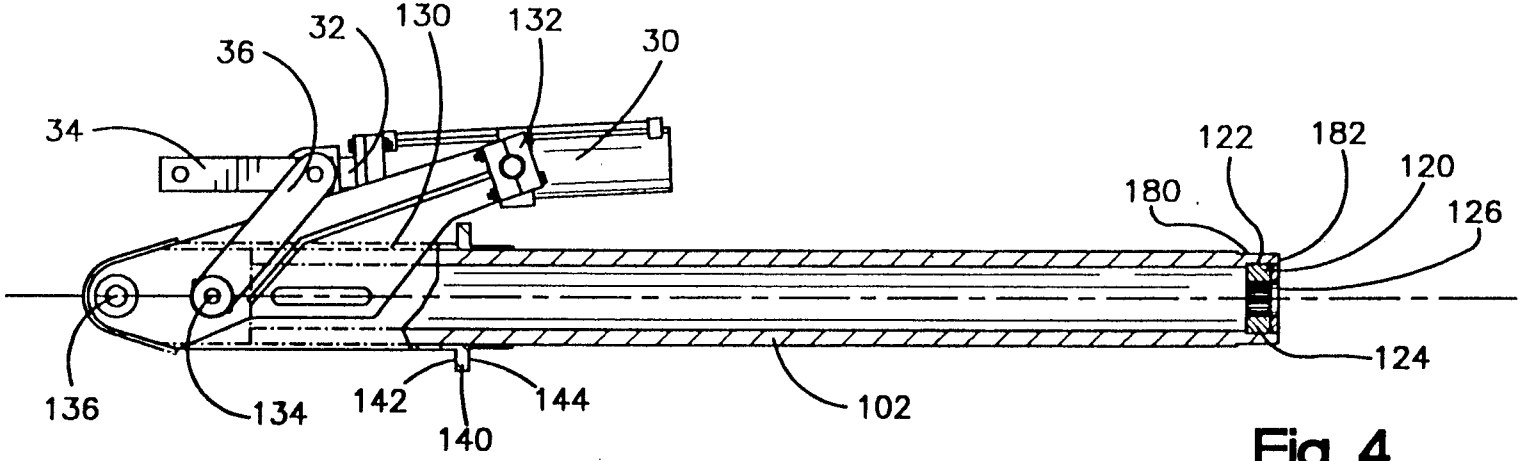
FIG. 4 is a side elevational view of the shaft of the rotating stick broken away to show the end plate which engages the splined axle of the hydraulic actuator.
Figure 7:
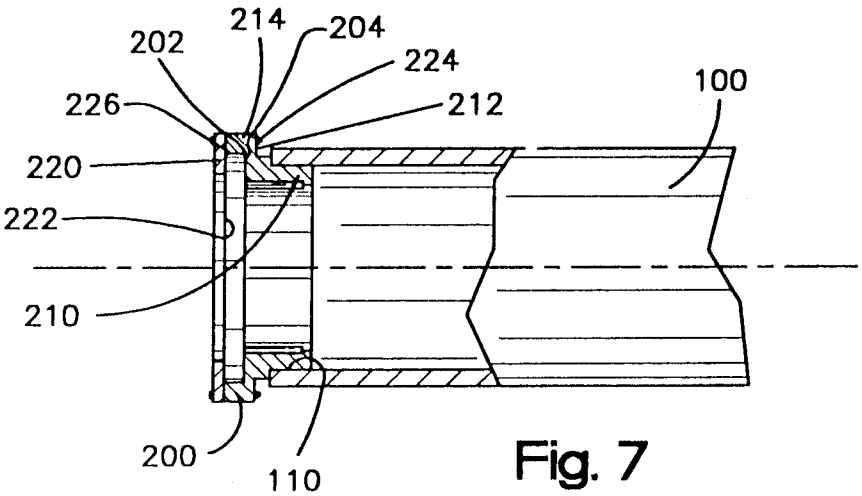
FIG. 7 is an enlarged view of a portion of the rotating stick of FIG. 3 showing the details of the second bearing supporting the shaft at the distal end of the outer casing.
Figure 5:
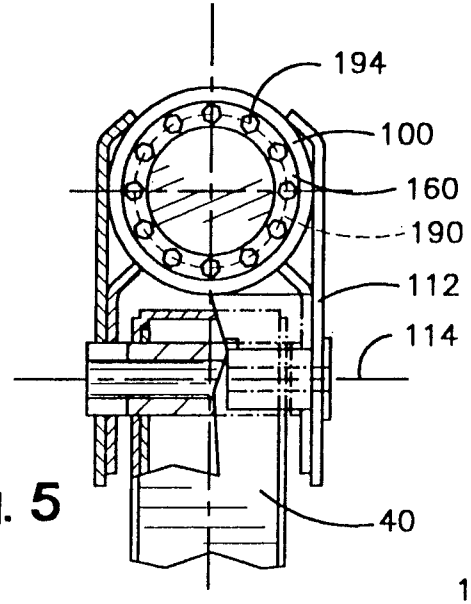
FIG. 5 is a cross-sectional view of the rotating stick taken along the line 5–5 in FIG. 2 showing the clevis for coupling the rotating stick to a boom member.

In a preferred form, the outer casing 100 is an elongated metallic cylindrical tube having an inner diameter significantly greater than the outer diameter of the shaft 102, and a distal mouth portion 110 through which the shaft 102 passes distally out of the outer casing 100. At the proximal end **100*a* of the outer casing 100 is a clevis 112. The rotating stick member 20 is pivotally coupled to the boom member 40 by a pin passing through a boom member pivot axis 114 on the clevis 112. Likewise, the piston rod 54 of the second linear actuator 51 (shown in FIG. 1) is pivotally coupled to the rotating stick member 20 by a pin passing through a cylinder axis 116 on the clevis 112. As shown in FIG. 2, the cylinder axis 116 is adjacent to and parallel with the boom member axis 114**.

In a preferred form, the shaft 102 is also an elongated metallic cylindrical tube. Near its proximal end **102*a*, the shaft 102 includes a region 120 of increased inner diameter which terminates in a shoulder 122. An end plate 124 is welded into this region 120 of increased inner diameter in abutment against a shoulder 122. The end plate 124 includes a central opening 126 with grooves for engagement with the rotary actuator 104**.

A sleeve 130 surrounds the distal end of the shaft 102. The sleeve 130 mounts a clevis 132 for coupling the first hydraulic cylinder 30 to the rotating stick member 20. The linkage 34 is pivotally coupled at one end to the shaft 102 by a pin 134 journaled in the sleeve 130 and at another end to the piston rod 32 of the linear actuator 31. An additional journal 136 is provided in the sleeve 130 for pivotally coupling the hammer 14 to the rotating stick member 20. Coupling the first linear actuator 31 and the hydraulic hammer 14 to the shaft 102 permits an operator to rotate the rotating stick member 20 and the hammer 14 independently of the pivoting of the hammer 14 on the end of the rotating stick member 20 so as to obtain 180° of movement in both the altitudinal and azimuthal directions.

An annular collar 140 is welded to the outside surface of the sleeve 130 near the proximal end 130*a* of the sleeve 130. This annular collar 140 defines a pair of shoulders 142, 144 (FIG. 4) which provide thrust surfaces that cooperate to position the shaft 102 axially with respect to the outer casing 100 and to transfer reaction forces from the shaft 102 to the outer casing 100.

The rotary actuator 104 is enclosed by the outer casing 100 and has a drive axle 150 (FIG. 6) coupled to the shaft 102 by means of a splined adapter 152. A preferred actuator for use in connection with the invention is that sold under the trademark HELAC by the Helac Corporation of Enumclaw, Wis. The HELAC actuator includes the drive shaft 150 which is splined to an adapter 152. The adapter 152 is itself splined to the end plate 124 welded to the shaft 102. While the drive axle 150 and adapter 152 are described and shown as splined, it is within the contemplation of the invention that the drive axle 150 be coupled directly to the end plate 124 or that the drive axle 150 or adapter 152 may be coupled by means other than splines, such as keys or lobed connections.

Figure 6:
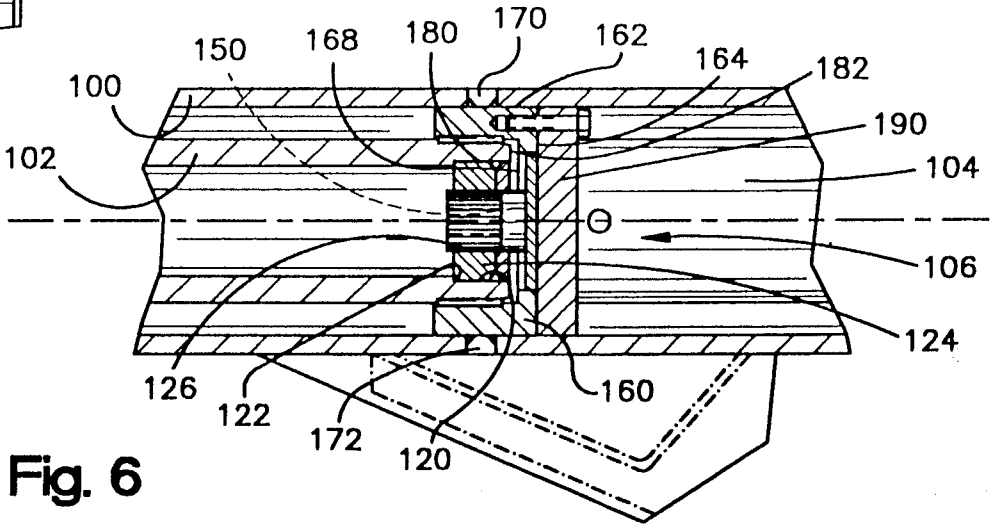
FIG. 6 is an enlarged view of a portion of the rotating stick of FIG. 2 showing the details of the first bearing supporting the shaft within the outer casing.

The shaft 102 is supported inside the outer casing 100 by the first and second journal bearings 106, 108. As best shown in FIG. 6, the first bearing 106 includes a first annular body 160 mounted inside the outer casing 100. A preferred form of the first annular body 160 has an "L"-shaped profile defining an outer annular surface 162, a rear axial surface 164, a first cylindrical bearing surface 166 facing radially inwardly for supporting a portion of the shaft 102 for relative rotation and a first transverse surface 168 facing in an axially distal direction. The first annular body 160 is enclosed by the outer casing 100 and welded in position through holes 170, 172.

In the embodiment shown in the drawing, the first annular body 160 defines a bearing sleeve which supports the proximal end 102*a* of the shaft 102 at a reduced-diameter portion 180. The outer surface of this reduced-diameter portion 160 is supported by the first bearing surface 166 while the distal end of the shaft 182 faces the first transverse surface 168. As is well known in the art, a lubricant may be provided between the reduced-diameter portion 180 of the shaft and the surfaces of the first annular body 160 to facilitate the rotation of the shaft 102 in the first bearing 106.

A preferred embodiment of the first annular body 160 is a diametrally separated two-piece structure having annular snaps and matching re-entrant slots for securing the two pieces into a general ring-shape. In alternative embodiments, one or more additional annular bodies (not shown) may be inserted between the first annular body 160 (welded to the outer casing 100) and the surface of the shaft 102. These additional annular bodies may be fixed, as by a bolt or cotter, with respect to either the first annular body 160 or the shaft 102. The additional annular bodies may be of the same or different material from the first annular body 160. While such an additional annular body may provide added stability against buckling, it is unnecessary in the preferred embodiment where the torsional load is relatively stable.

The first annular body 160 supports a mounting plate portion 190 of the housing of the rotary actuator 104. As shown, the outer diameter of the mounting plate portion 190 is slightly less than the inner diameter of the opposed inner surface of the outer casing 100.

The rotary actuator 104 is supported on the first annular body 160 by means of a set of bolts 194 (only one shown in FIG. 6) which pass through the mounting plate portion 190 and the first annular body 160. In the alternative embodiment in which an additional annular body is coupled between the first annular body 160 and the shaft 102, the additional annular body may be "L"-shaped with a proximal flange portion projecting radially outward between the first annular body 160 and the mounting plate portion 190 so that a single set of fasteners may be passed through the housing of the actuator 104, the mounting plate portion 190, the flange on the additional annular body and the first annular body 160 to couple the elements together. The use of a single set of fasteners to secure the elements together reduces the number of parts and improves the reliability of the rotating stick 20.

The second bearing 108 is located at the mouth 110 of the outer casing 100. This second bearing 108 is constructed of a second annular body 200 defining a second bearing surface 202 for supporting a portion of the shaft 102 for relative rotation and a second transverse surface 204 for engaging the radial face 142 on the annular collar 140 to support the shaft 102 against relative axial movement. In the embodiment shown in the drawing (see FIG. 7), the second annular body 200 includes a first annular ring portion 210 supported and partially enclosed by the distal mouth portion 110 of the outer casing 100, the first annular ring portion 210 having an inner diameter greater than an outer diameter of the adjacent portion of the shaft 102; a radial flange portion 212 extending from a distal portion of the first annular ring portion 210; and a second annular ring portion 214 extending radially from an outer annular portion of the radial flange portion 212, the second annular ring portion having an inner diameter greater than an outer diameter of the collar 140 welded to the shaft 102.

An end plate 220 with a circular central opening 222 is supported at the distal end of the second annular ring portion 214 by means of bolts 224 (only two shown). The central opening 222 has a diameter smaller than the outer diameter of the collar 140 and larger than the diameter of the shaft 102 and sleeve 130. The shaft 102 passes Outside of the outer casing 100 through opening 222.

The shaft 102 is positioned so that the collar 140 is located between the radial flange portion 212 and the end plate 220. The radial flange portion 212 defines the second transverse surface 204 adjacent the face 142 on the collar 140 while the end plate 220 defines a thrust surface 226 adjacent the face 144 on the collar 140. These surfaces 204, 226 of the bearing 108 and faces 142, 144 of the collar 140 interact to support the shaft 102 against relative axial movement and to transfer elastic waves from the shaft 102 to the outer casing 100.

In use, periodic forces are generated by the hydraulic hammer 14 and propagate back along the shaft 102 as elastic waves. A portion of the energy from these elastic waves is transferred to the outer casing 100 by the second bearing 108. This portion of the energy is dissipated by the outer casing 100 so that the intensity of the elastic waves reaching the hydraulic actuator 104 is reduced. Preferably, the first annular body 160 and the second annular body 200 are formed of polymer (either as single pieces or in semiannular pieces with interlocking end portions), so as to aid in damping compressive shock waves.

While, in the embodiment shown in the accompanying drawing, the shaft 102 is aligned with a central axis 109 of the outer casing 100, the shaft 102 may also be displaced from the central axis 109 if clearance is provided to permit the shaft 102 to rotate inside the outer casing 100. Likewise, while the cross-sections of the outer casing 100 and shaft 102 as shown in the drawings are circular, it is possible that other cross-sections might be used. Were a cross-section other than circular chosen for the outer casing 100, it would be necessary to change the outer contour of the first and second annular bodies 160, 200 correspondingly so that the two bodies could be mounted firmly in the outer casing 100.

As indicated previously, the boom member 40 pivotally supports the rotating stick member 20 by means of the clevis 112 along the boom member pivot axis 114 (FIG. 1). A preferred boom member 40 consists of a metallic arm having a box cross-section. The boom includes an upper ear 230 which is pivotally coupled to the cylinder 50 of the second linear actuator 51 along a pivot axis 52 and a lower clevis 232 which is coupled to the piston rod 74 of the third linear actuator 71 along a pivot axis 76. The second linear actuator 51 pivots the rotating stick member 20 with respect to the boom member 40 for movement in an imaginary plane containing the central axis 238 of the boom and the central axis 92 of the rotating stick (that is, in the plane of FIG. 1).

The base 60 pivotally supports the boom member 40 at pivot axis 240. The base 60 is fixed to the platform 12 by means of bolts 242 which pass through the foot of the base 60 and into the platform 12. The base 60 includes an ear 244 which is coupled to the proximal end 72 of the third hydraulic cylinder 70. The third hydraulic cylinder 70 pivots the boom member 40 with respect to the base 20.

In use, the piston rod 74 of the third linear actuator 71 is extended or retracted to position the boom member 40 such that the rotating stick member 20 has the fullest possible access to the smelting drum 16. The second linear actuator 51 pivots the rotating stick member 20 relative to the distal end of the boom member 40 so as to position the hydraulic hammer 14 as close as possible to a hardened deposit on the inner surface of the smelting drum 16 to be cleaned. The rotary actuator 104 and first hydraulic cylinder 30 point the hydraulic hammer 14 so that a chisel at the end of the hydraulic hammer 14 may chisel away the deposit. The rotary actuator 104 and first linear actuator 31 are capable of orienting the hammer independently, so that the first linear actuator 31 pivots the hydraulic hammer 14 though at least 180° of altitude and the rotary actuator 104 rotates the hammer through at least 180° of azimuth.

Variations and modifications of the invention will be apparent to those skilled in the art from the above detailed description of the preferred embodiment. Therefore, it is to be understood that, within the scope of the appended claims, the invention may be practiced otherwise than as specifically shown and described.

What I claim is:

1. A rotating stick for a boom comprising:
a) a shaft;
b) a rotary actuator having a drive axle aligned with the shaft;
c) coupling means on the drive axle and shaft for constraining the shaft to rotate with the drive axle while limiting transfer of thrust from the shaft to the drive axle;
d) an outer casing enclosing the rotary actuator and at least partially enclosing the shaft, the outer casing having a mouth at an end opposite the rotary actuator through which the shaft projects;
e) a first bearing inside the outer casing near the rotary actuator for supporting a portion of the shaft for relative rotation; and
f) a second bearing near the mouth of the outer casing having structure defining a surface for supporting the shaft against radial and axial movement, so that at least some axial translational energy of the shaft is transferred from the shaft to the outer casing near the end of the outer casing opposite the rotary actuator.

2. A rotating stick according to claim 1, wherein the coupling means includes a straight spline fixed to the drive axle of the rotary actuator for engagement with reciprocal structure on the shaft.

3. A rotating stick according to claim 2 wherein the shaft comprises a hollow tube having an end plate that forms the means for mating with the rotatable spline.

4. A rotatable stick member for a boom comprising:
a) a shaft;
b) a rotary actuator aligned with and coupled to the shaft for rotating the shaft about its axis;
c) an outer casing enclosing the rotary actuator and at least partially enclosing the shaft, the outer casing supporting the rotary actuator near an end of the casing and having a mouth near an opposite end through which the shaft projects;
d) first bearing means including a first annular body mounted inside the outer casing for rotatably supporting a first portion of the shaft near the rotary actuator; and
e) second bearing means including a structure on the shaft defining a radial face and a second annular body supported by the outer casing near the mouth of the outer casing for rotatably supporting a second portion of the shaft and for supporting the shaft against movement along the axis of the shaft;
f) wherein the second annular body includes:
i) a first annular ring portion supported and partially enclosed by the mouth of the outer casing, the first annular ring portion having an inner diameter greater than an outer diameter of the second portion of the shaft;
ii) a radial flange portion extending radially outwardly from the first annular ring portion outside the outer casing; and
iii) a second annular ring portion extending axially from an outer annular portion of the radial flange portion, the second annular ring portion having an inner diameter greater than an outer diameter of the radial face defined by the structure on the shaft; and g) wherein the second bearing also includes a plate fixed to the second annular ring portion, the plate including a central opening through which the shaft passes, this central opening having an inner diameter smaller than the outer diameter of the structure defining the radial face positioned on the shaft.

5. A rotatable stick member for a boom comprising:

a) a shaft;

b) a rotary actuator aligned with and coupled to the shaft for rotating the shaft about its axis;

c) an outer casing enclosing the rotary actuator and at least partially enclosing the shaft, the outer casing supporting the rotary actuator near an end of the casing and having a mouth near an opposite end through which the shaft projects;

d) first bearing means including a first annular body mounted inside the outer casing for rotatably supporting a first portion of the shaft near the rotary actuator;

e) second bearing means including a structure on the shaft defining a radial face and a second annular body supported by the outer casing near the mouth of the outer casing for rotatably supporting a second portion of the shaft and for supporting the shaft against movement along the axis of the shaft; and f) a mounting plate receivable in the outer casing and a fastener passing through the mounting plate and into the first annular body for coupling the rotary actuator to the first annular body for support of the rotary actuator.

* * * * *